US007832569B1

(12) United States Patent
Nemenz

(10) Patent No.: US 7,832,569 B1
(45) Date of Patent: Nov. 16, 2010

(54) ADJUSTABLE CLOTHING DISPLAY RACK

(76) Inventor: Stefan Nemenz, 13059 Bullock Greenway Blvd., Charlotte, NC (US) 28277

( * ) Notice: Subject to any disclaimer, the term of this patent is extended or adjusted under 35 U.S.C. 154(b) by 14 days.

(21) Appl. No.: 11/708,969

(22) Filed: Feb. 21, 2007

(51) Int. Cl.
*A47F 7/24* (2006.01)
*A41H 5/00* (2006.01)

(52) U.S. Cl. ..... 211/85.3; 223/68

(58) Field of Classification Search ..... 211/1.3, 211/85.3, 107, 119.13, 124, 172, 175, 189, 211/195, 196, 197, 205, 206; 248/122.1, 248/124.1, 128.8, 166, 172, 173; 223/68, 223/120, 66, 69
See application file for complete search history.

(56) References Cited

U.S. PATENT DOCUMENTS 114,934 A * 5/1871 Flanders ..... 211/196
182,577 A * 9/1876 Hatch ..... 223/68
207,351 A * 8/1878 Ferris ..... 223/68
233,239 A * 10/1880 Hall ..... 223/68
233,240 A * 10/1880 Hall ..... 223/68
236,887 A * 1/1881 Hall ..... 223/68
243,703 A * 7/1881 Hall ..... 223/68
244,682 A * 7/1881 Snyder ..... 101/404
288,452 A * 11/1883 Knapp ..... 223/68
290,990 A * 12/1883 Knapp ..... 223/68
307,960 A * 11/1884 Knapp ..... 223/68
535,685 A * 3/1895 Dunstane ..... 248/462
593,139 A * 11/1897 Thomas ..... 432/231
699,971 A * 5/1902 Poschmann ..... 16/87.4 R
720,833 A * 2/1903 Messick ..... 211/85.3
850,363 A * 4/1907 Frankel ..... 211/85.3
1,188,921 A * 6/1916 Finkelstein ..... 223/90
1,450,416 A * 4/1923 Freshour et. al. ..... 223/120
1,590,637 A * 6/1926 Marengo ..... 248/158
1,591,786 A * 7/1926 Simpson ..... 223/88
1,786,308 A * 12/1930 Latourelle et al. ..... 248/155
1,804,069 A * 5/1931 Stover ..... 211/85.3
1,893,570 A * 1/1933 Waite ..... 211/85.3
1,989,458 A * 1/1935 Martin ..... 223/69
2,108,757 A * 2/1938 Harrison ..... 223/68
2,114,250 A * 4/1938 Joyce ..... 223/68
2,129,426 A * 9/1938 Jenks ..... 211/107
2,137,691 A * 11/1938 Landsman ..... 223/69
2,186,300 A * 1/1940 Lamar ..... 248/124.1
2,196,729 A * 4/1940 Harrison ..... 223/68
2,246,441 A * 6/1941 Hurlbut ..... 248/27.8
2,274,165 A * 2/1942 Ritzau ..... 211/49.1
2,299,683 A * 10/1942 Lester ..... 248/122.1
2,484,805 A * 10/1949 Albert ..... 223/69
2,707,566 A * 5/1955 Eaton et. al. ..... 211/163
2,754,076 A * 7/1956 Westervelt ..... 248/97
2,763,453 A * 9/1956 Palino ..... 248/514
2,885,090 A * 5/1959 Forman et. al. ..... 211/175
3,023,940 A * 3/1962 Schwartz ..... 223/39
3,076,557 A * 2/1963 Husted et al. ..... 211/196

(Continued)

*Primary Examiner*—Darnell M Jayne
*Assistant Examiner*—Joshua Rodden
(74) *Attorney, Agent, or Firm*—Schwartz Law Firm, P.C.

(57) ABSTRACT

An adjustable clothing display rack includes a base, a waist attached to the base, first and second laterally-spaced adjustable sides, and first and second shoulders. The adjustable sides have respective upper and lower ends. The lower ends are pivotably attached to the waist, such that the lateral spacing of the upper ends is adjustable independent of the lateral spacing of the lower ends. The first and second shoulders are formed at respective upper ends of the first and second sides.

15 Claims, 4 Drawing Sheets

U.S. PATENT DOCUMENTS 3,132,747 A * 5/1964 Van Duyne ..... 211/205
3,149,728 A * 9/1964 McNeil ..... 211/169
4,665,638 A * 5/1987 Morton ..... 38/102.1
4,895,261 A * 1/1990 Yacobian ..... 211/196
D311,099 S * 10/1990 Yau Kee ..... D6/397
5,078,348 A * 1/1992 Babitchenko ..... 248/125.1
5,248,047 A * 9/1993 Randhawa ..... 211/85.3
5,348,165 A * 9/1994 Pomerleau ..... 211/85.3
5,503,356 A * 4/1996 Shelby ..... 248/170
5,509,545 A * 4/1996 Banke ..... 211/205
5,573,150 A * 11/1996 Trujillo ..... 223/66
D391,706 S * 3/1998 Malcolm ..... D32/35
D397,706 S * 9/1998 Shibata ..... D32/35
5,819,961 A * 10/1998 Harris ..... 211/196
D410,804 S * 6/1999 Murray ..... D6/455
D414,625 S * 10/1999 Stelmarski ..... D6/411
6,389,721 B1 * 5/2002 Yang ..... 40/610
6,438,889 B1 * 8/2002 Handy ..... 43/21.2
6,749,073 B2 * 6/2004 McNab ..... 211/85.3
6,974,043 B1 * 12/2005 Lai ..... 211/205
6,978,904 B1 * 12/2005 Lam ..... 211/85.3
7,077,276 B1 * 7/2006 Romano ..... 211/196
2003/0222038 A1 * 12/2003 Collier ..... 211/85.7
2005/0161415 A1 * 7/2005 Iversen et al. ..... 211/85.3
2006/0011674 A1 * 1/2006 Finch et al. ..... 223/120

* cited by examiner

ADJUSTABLE CLOTHING DISPLAY RACK

TECHNICAL FIELD AND BACKGROUND

The present invention relates generally to an adjustable clothing display rack. In exemplary implementations, the invention is lightweight, portable, and readily custom-adjusted to carry and effectively display clothing of various sizes.

SUMMARY OF EXEMPLARY EMBODIMENTS

Therefore, it is an object of the invention to provide an adjustable clothing display rack.

It is another object of the invention to provide an adjustable clothing display rack which in one exemplary implementation comprises multiple points of adjustment.

It is another object of the invention to provide an adjustable clothing display rack which in one exemplary implementation is applicable to help coordinate articles of apparel and accessories before wearing by a user.

It is another object of the invention to provide an adjustable clothing display rack which in one exemplary implementation is designed for use by retail clothing stores.

It is another object of the invention to provide an adjustable clothing display rack which in one exemplary implementation is designed for home use by consumers.

It is another object of the invention to provide an adjustable clothing display rack which in one exemplary implementation is designed for ready and convenient size adjustment to meet the needs of any particular user.

These and other objects of the present invention are achieved in the exemplary embodiments disclosed below by providing an adjustable clothing display rack. The rack includes a base, a waist attached to the base, first and second laterally-spaced adjustable sides, and first and second shoulders. The adjustable sides have respective upper and lower ends. The lower ends are pivotably attached to the waist, whereby the lateral spacing of the upper ends is adjustable independent of the lateral spacing of the lower ends. The first and second shoulders are formed at respective upper ends of the first and second sides.

The following terms are used broadly herein, and are intended to be construed in a manner consistent with the definitions provided below.

The term "base" means the bottom or lowest supporting structure of the display rack.

The term "waist" means the structure of the display rack intermediate the base and the shoulders. The waist may or may not form a constricted or narrowed portion of the rack. Additionally, in one exemplary implementation, the waist may comprise the base of the rack, wherein the rack is designed for placement on a raised surface, platform, counter, desk, or the like.

The term "shoulder(s)" means that portion of the rack located above the waist, and having a lateral dimension sufficient for holding and displaying an article of clothing, such as a dress shirt.

The term "neck" means a relatively narrow projection extending vertically above the shoulders—the projection being more narrow than the lateral dimension (width) of the shoulders.

The term "attached" means the state of two elements joined, connected, or integrally formed together. The attached elements may comprise previously separate and distinct parts, or a single homogenous structure.

The term "rack" means any framework for holding and displaying articles of clothing.

According to another exemplary embodiment of the invention, the first and second sides comprise respective elongated side bars.

According to another exemplary embodiment of the invention, each of the first and second side bars incorporates adjustable telescoping segments.

According to another exemplary embodiment of the invention, the waist includes an adjustable crossbar assembly having at least one telescoping segment.

According to another exemplary embodiment of the invention, the crossbar assembly includes a T-shaped connector.

According to another exemplary embodiment of the invention, the base includes an elongated vertical leg bar having top and bottom ends. The top end is attached to the waist at the T-shaped connector.

According to another exemplary embodiment of the invention, the vertical leg bar incorporates adjustable telescoping segments.

According to another exemplary embodiment of the invention, the base further includes a pivoted foot attached to the bottom end of the leg bar.

According to another exemplary embodiment of the invention, the pivoted foot comprises a substantially round plate.

According to another exemplary embodiment of the invention, a raised neck is located between the shoulders.

According to another exemplary embodiment of the invention, the raised neck comprises an arcuate neck bar having opposite ends attached to respective shoulders.

According to another exemplary embodiment of the invention, the shoulders comprise respective elongated shoulder bars adjustably attached to the ends of the neck bar, such that the shoulders are movable inwardly and outwardly relative to the neck.

According to another exemplary embodiment of the invention, the shoulder bars are integrally formed with respective upper ends of the first and second sides.

According to another exemplary embodiment of the invention, an article clip is attached to at least one of the shoulders.

According to another exemplary embodiment of the invention, at least one article clip is attached to the waist.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
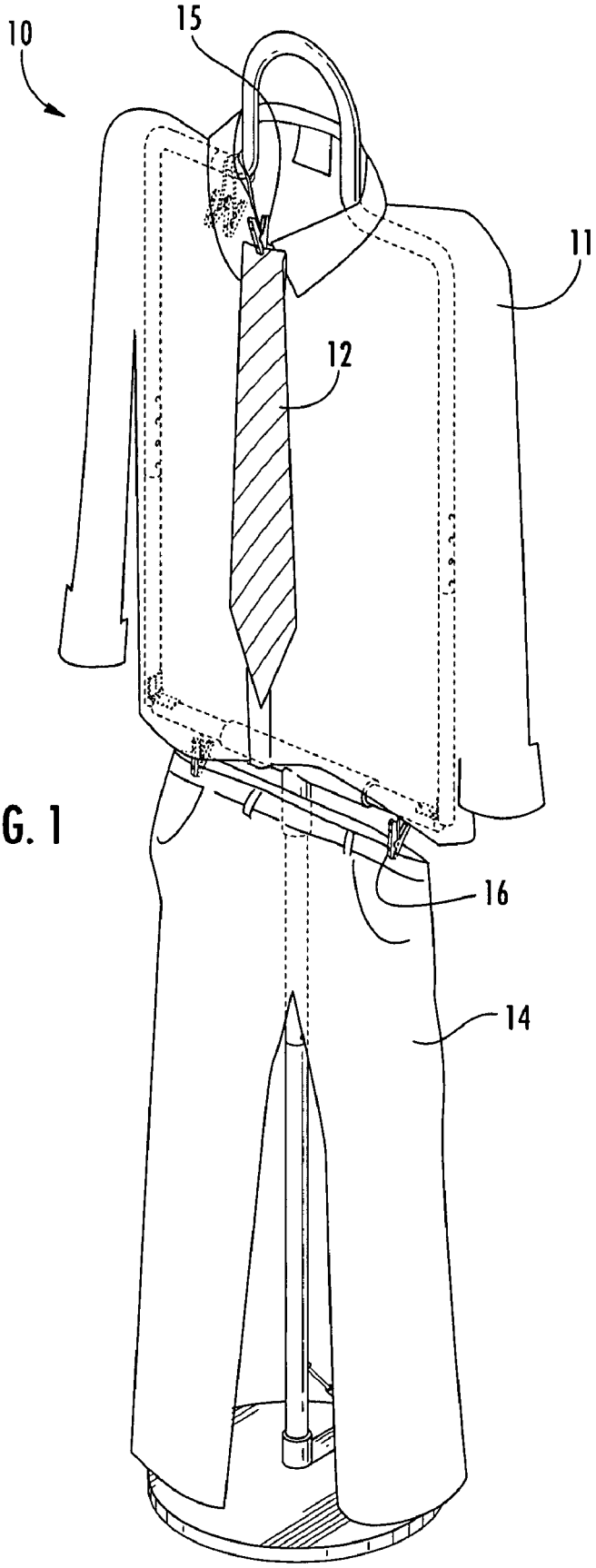
FIG. 1 is an environmental perspective view of an adjustable clothing display rack according to one preferred embodiment of the present invention.

Referring now specifically to the drawings, an adjustable clothing display rack according to an exemplary embodiment of the present invention is illustrated in FIG. 1 and shown generally at reference numeral 10. The clothing display rack 10 is especially applicable for carrying articles of clothing and accessories for display to a user to indicate the overall appearance of an assembled outfit. In the implementation shown, the display rack 10 carries a dress shirt 11, necktie 12, and slacks 14. The necktie 12 and slacks 14 are suspended from respective article clips 15 and 16. Other articles (not shown), such as hats, belts, shoes, scarfs, coats, suit jackets, and the like may also be displayed in a similar manner.

Figure 2:
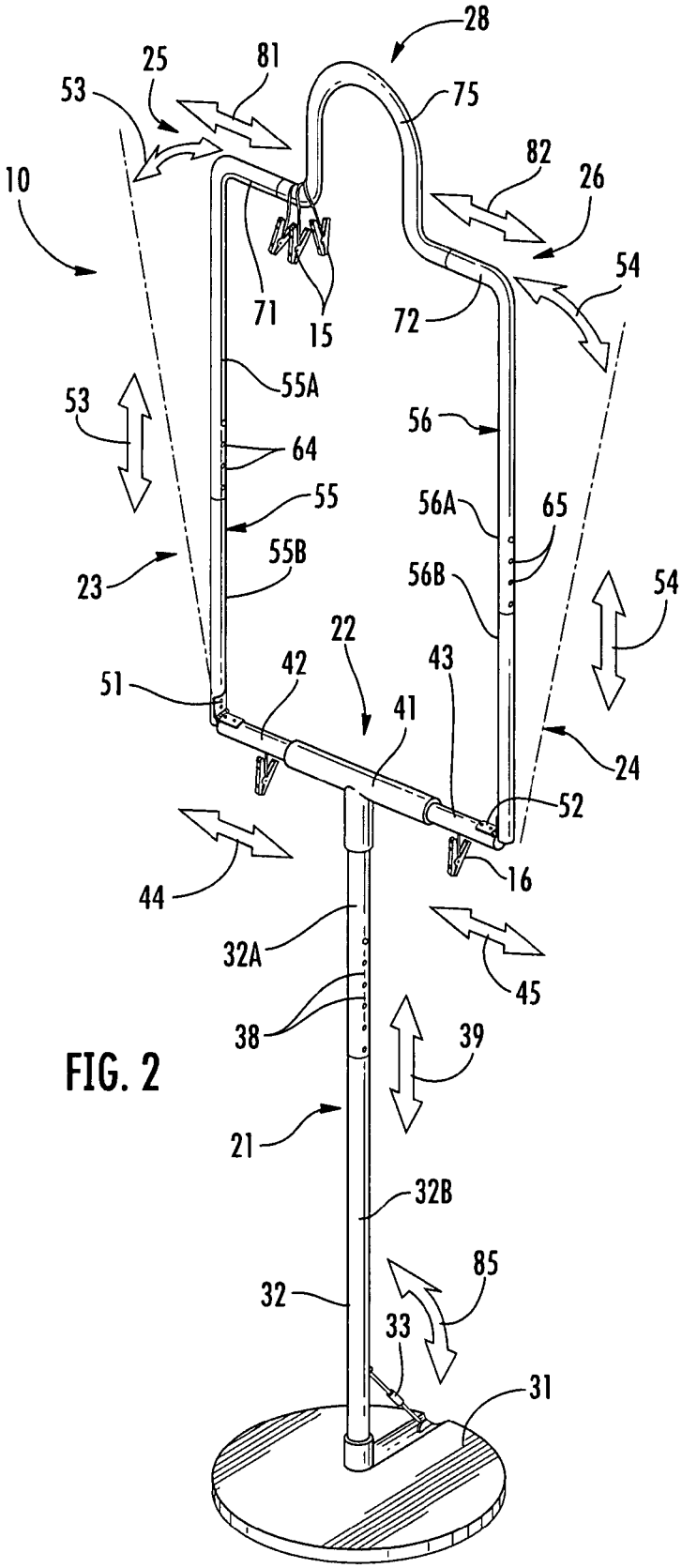
FIG. 2 is a further perspective view of the clothing display rack with direction arrows indicating various adjustable components of the rack.
Figure 3:
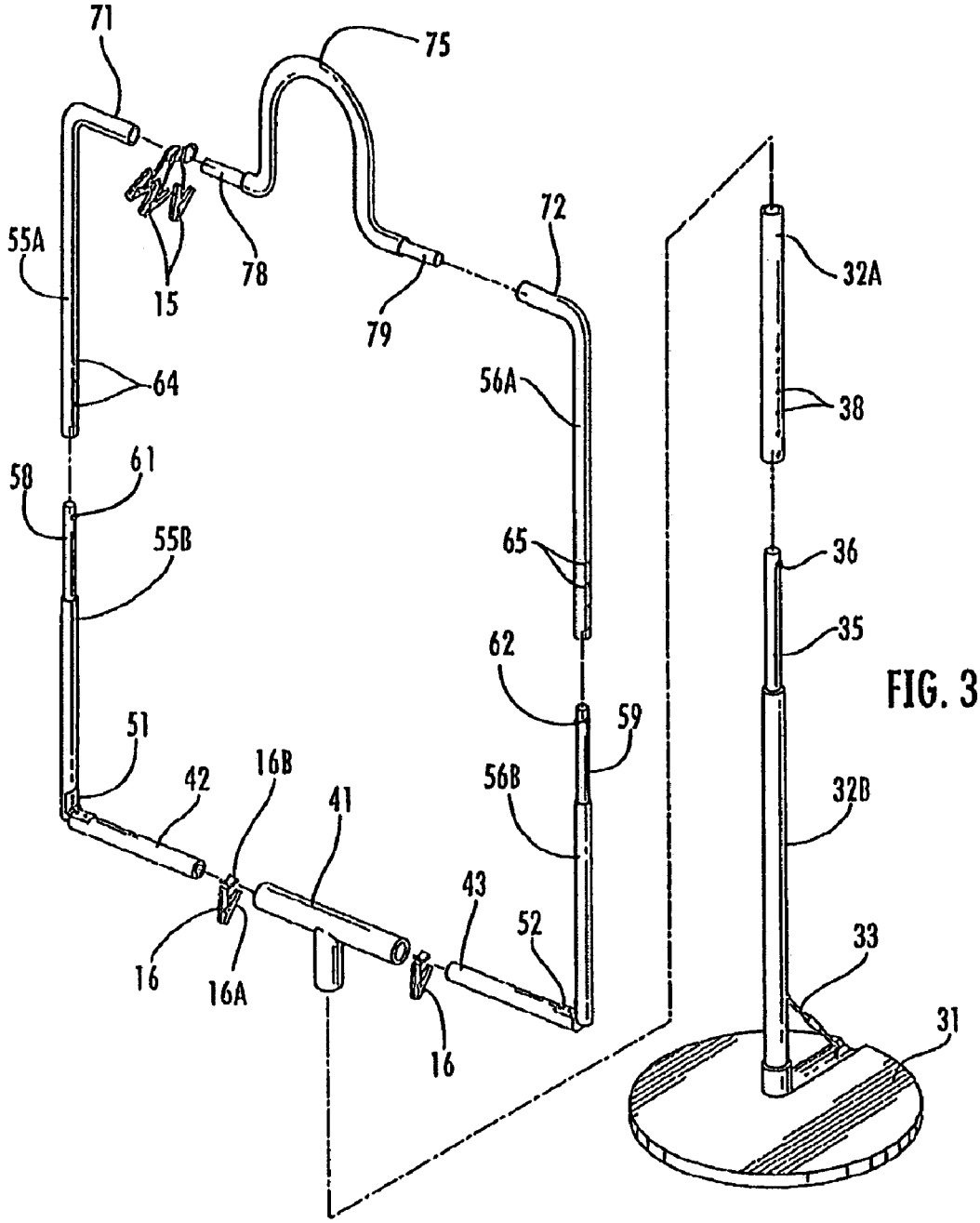
FIG. 3 is an exploded view of the clothing display rack.

As best shown in FIGS. 2 and 3, the display rack 10 comprises an adjustable, substantially rigid framework of interconnected, telescoping segments forming a base 21, a waist 22, opposing sides 23, 24, shoulders 25, 26, and a raised arcuate neck 28. The segments may be constructed of any suitable plastic material, fiberglass, aluminum, or other metal sufficient to support the weight of clothing articles applied to the rack 10.

The base 21 includes a pivoted annular plate 31, and a vertically-adjustable leg bar 32 comprising telescoping upper and lower segments 32A, 32B. A collapsible brace 33 releasably locks the base plate 31 in the open position shown in FIGS. 1-3. The lower leg segment 32B is affixed to the base plate 31 at its bottom end, while its top end defines an elongated adjustment section 35 of reduced diameter. The upper leg segment 32A has a hollow open end which is slidably received onto the adjustment section 35 of the lower segment 32B. The inside diameter of the upper segment 32A may be only slightly larger than the outer diameter of the lower segment 32B. A spring-loaded metal detent 36 formed with the adjustment section 35 operates to selectively align with one of a number of vertically spaced holes 38 formed with the upper segment 32A, thereby releasably locking the position of the upper segment 32A relative to the lower segment 32B and base plate 31. Outermost adjustment holes 38 set the base 21 at its minimum and maximum heights, respectively. The leg bar 32 is readily adjusted, as indicated by arrow 39 in FIG. 2, by stepping on the base plate 31 and sliding the upper segment 32A upwardly or downwardly relative to the lower segment 32B.

The waist 22 comprises a lateral crossbar assembly including a hollow T-shaped connector 41, and opposing telescoping hollow waist segments 42 and 43. The connector 41 attaches at the top of the upper leg segment 32A, and to respective proximal ends of the waist segments 42, 43. The inside diameter of the connector 41 is only slightly larger than the outside diameter of the waist segments 42, 43, such that the waist segments 42, 43 are frictionally secured to the connector 41 and slidably adjusted as indicated by arrows 44 and 45 in FIG. 2. The hollow connector 41 may be formed in any desired length—the length defining a lateral range of adjustment of the waist 22. Additionally, one or more of the connector 41 and waist segments 42, 43 may have a longitudinal slot (not shown) forming a track to allow sliding lateral repositioning of the article clips 16. In this embodiment, each article clip 16 is suspended from a flexible line 16A attached to an enlarged stop 16B (FIG. 3) which travels inside the hollow waist segment 42, 43 as the clip 16 is slid laterally along the waist 22.

The sides 23, 24 of the display rack 10 are pivotably attached to distal ends of the waist segments 42, 43 by respective hinges 51 and 52. The hinges 51, 52 allow angular adjustment of the sides 23, 24 relative to the waist 22, as indicated by arrows 53 and 54 of FIG. 2. Each side 23, 24 comprises vertically adjustable side bars 55 and 56 having respective telescoping upper and lower side segments 55A, 55B and 56A, 56B. For each side bar 55, 56, the lower leg segment 55B, 56B is affixed to the waist 22 at its bottom end, while the top end defines a reduced-diameter adjustment section 58, 59. The upper side segments 55A, 56A define respective hollow open ends which are slidably received onto the adjustment sections 58, 59 of the lower segments 55B, 56B. The inside diameter of the upper segments 55A, 56A may be only slightly larger than the outside diameter of the adjustment sections 58, 59. Spring-loaded detents 61, 62 formed with the adjustment sections 58, 59 operate to selectively align with one of a number of vertically spaced holes 64, 65 formed with the upper segments 55A, 56A, thereby releasably locking the position of the upper segments 55A, 56A relative to the lower segments 55B, 56B and waist 22.

In the embodiment shown, the shoulders 25, 26 comprise respective shoulder bars 71 and 72 integrally formed with the upper side segments 55A, 56A, and extending inwardly towards the raised neck 28 of the clothing rack 10. The neck 28 comprises an arcuate neck bar 75 having opposite ends of reduced diameter. The ends define respective adjustment sections 78 and 79 designed to receive hollow ends of the shoulder bars 71, 72. The inside diameter of the shoulder bars 71, 72 is only slightly larger than the outside diameter of the neck bar adjustment sections 78, 79, such that the shoulder bars 71, 72 are frictionally secured to the neck bar 75. Sufficient flex in the shoulders 25, 26 and neck 28 allows lateral shoulder adjustment, as indicated by arrows 81 and 82 in FIG. 2, while the sides 23, 24 of the rack 10 pivot simultaneously at respective hinges 51, 52. One or more article clips 15 may be provided in an area of the neck and shoulder.

Figure 4:
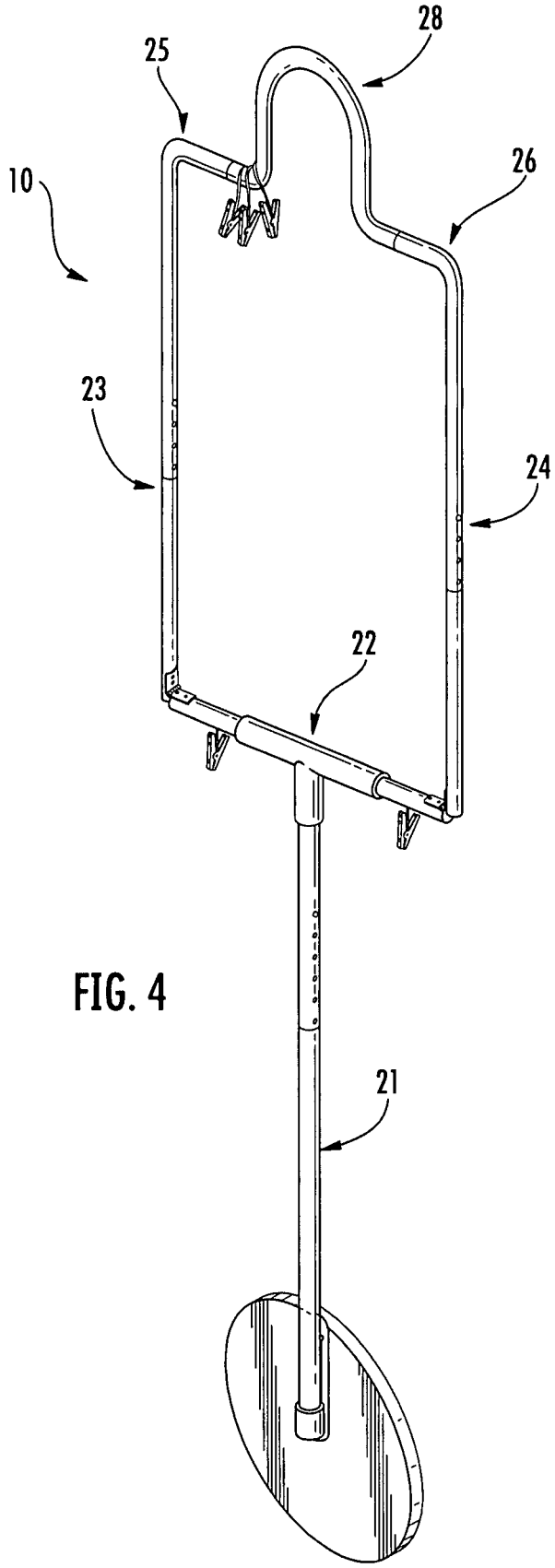
FIG. 4 is perspective view of the clothing display rack in a condition of reduced size and profile.

For convenient storage and transport, the display rack 10 can be quickly adjusted to the relatively small configuration and profile shown in FIG. 4. In this configuration, the base plate 31 is pivoted upwardly as indicated at arrow 85 in FIG. 2. Additionally, one or more parts of the display rack 10 may be readily disassembled by separating the attachable segments illustrated in FIG. 3.

Exemplary embodiments of the present invention are described above. No element, act, or instruction used in this description should be construed as critical or essential to the invention unless explicitly described as such. Various details of the invention may be changed without departing from its scope. Furthermore, the foregoing description of the exemplary embodiments of the invention and best mode for practicing the invention are provided for the purpose of illustration only and not for the purpose of limitation—the invention being defined by the claims and their equivalents.

I claim:

1. An adjustable clothing display rack, comprising:

a base;

a waist attached to said base, and comprising telescoping segments adapted for adjusting a lateral dimension of said waist;

first and second laterally-spaced adjustable sides having respective upper and lower ends, the lower ends being pivotably attached to said waist; and first and second laterally spaced shoulders formed at respective upper ends of said first and second sides, and comprising respective first and second inwardly directed shoulder bars; a raised neck located between said first and second shoulders, and comprising an upwardly extending neck bar having opposite ends telescopically joined to said respective first and second shoulder bars, wherein the opposite ends of said neck bar and said respective first and second shoulder bars are frictionally secured together and adapted for allowing sufficient flex in said shoulders and neck to enable inward and outward lateral shoulder adjustment independent of the lateral dimension of said waist, such that lateral adjustment of said shoulders and/or lateral adjustment of said waist modifies an angle of said sides to said shoulders and waist to accommodate and display garments designed for individuals with a variety of body shapes.

2. An adjustable clothing display rack according to claim 1, wherein said first and second sides comprise respective elongated side bars.

3. An adjustable clothing display rack according to claim 2, wherein each of said first and second side bars comprises adjustable telescoping segments.

4. An adjustable clothing display rack according to claim 1, wherein said waist comprises an adjustable crossbar assembly having telescoping segments.

5. An adjustable clothing display rack according to claim 4, wherein said crossbar assembly comprises a T-shaped connector.

6. An adjustable clothing display rack according to claim 5, wherein said base comprises an elongated vertical leg bar having top and bottom ends, the top end being attached to said waist at said T-shaped connector.

7. An adjustable clothing display rack according to claim 6, wherein said vertical leg bar comprises adjustable telescoping segments.

8. An adjustable clothing display rack according to claim 6, wherein said base further comprises a foot pivotally attached to the bottom end of said leg bar.

9. An adjustable clothing display rack according to claim 8, wherein said pivoted foot comprises a substantially round plate.

10. An adjustable clothing display rack according to claim 1, wherein said shoulder bars are integrally formed with respective upper ends of said first and second sides.

11. An adjustable clothing display rack according to claim 1, and comprising an article clip attached to at least one of said shoulders.

12. An adjustable clothing display rack according to claim 1, and comprising at least one article clip attached to said waist.

13. An adjustable clothing display rack, comprising:

a base;

a waist attached to said base, and comprising an adjustable crossbar assembly having telescoping segments adapted for adjusting a lateral dimension of said waist;

first and second laterally-spaced adjustable sides having respective upper and lower ends, the lower ends being pivotably attached to said waist; and first and second laterally spaced shoulders formed at respective upper ends of said first and second sides, and comprising respective first and second inwardly directed shoulder bars; a raised neck located between said first and second shoulders, and comprising an upwardly extending neck bar having opposite ends telescopically joined to said respective first and second shoulder bars, wherein the opposite ends of said neck bar and said respective first and second shoulder bars are frictionally secured together and adapted for allowing sufficient flex in said shoulders and neck to enable and comprising telescoping segments capable of enabling inward and outward lateral shoulder adjustment independent of the lateral dimension of said waist, such that lateral adjustment of said shoulders and/or lateral adjustment of said waist modifies an angle of said sides to said shoulders and waist to accommodate and display garments designed for individuals with a variety of body shapes.

14. An adjustable clothing display rack according to claim 13, wherein said shoulder bars are integrally formed with respective upper ends of said first and second sides.

15. An adjustable clothing display rack according to claim 13, wherein said base comprises an elongated vertical leg bar having top and bottom ends, the top end being attached to said waist; and a foot pivotally attached to the bottom end of said leg bar.

* * * * *